US008106573B2

(12) United States Patent
Boehler et al.

(10) Patent No.: US 8,106,573 B2
(45) **Date of Patent: *Jan. 31, 2012**

(54) PLATINUM ALLOY FOR SPARK PLUG ELECTRODES AND SPARK PLUG HAVING A PLATINUM ALLOY ELECTRODE

(75) Inventors: Jeffrey T. Boehler, Holland, OH (US); Eric P. Passman, Piscataway, NJ (US)

(73) Assignee: FRAM Group IP LLC, Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/760,899

(22) Filed: Apr. 15, 2010

(65) Prior Publication Data

US 2010/0253204 A1 Oct. 7, 2010

Related U.S. Application Data

(63) Continuation of application No. 11/781,134, filed on Jul. 20, 2007, now Pat. No. 7,719,172.

(60) Provisional application No. 60/832,839, filed on Jul. 24, 2006.

(51) Int. Cl.
*H01T 13/39* (2006.01)
*H01T 13/20* (2006.01)

(52) U.S. Cl. ..... 313/141; 313/143

(58) Field of Classification Search ..... 313/118–145; 123/169 EL
See application file for complete search history.

(56) References Cited

U.S. PATENT DOCUMENTS 4,743,793 A * 5/1988 Toya et al. ..... 313/141
7,719,172 B2 * 5/2010 Boehler et al. ..... 313/141

FOREIGN PATENT DOCUMENTS

GB 2299813 A * 10/1996

* cited by examiner

*Primary Examiner* — Mariceli Santiago
(74) *Attorney, Agent, or Firm* — Cantor Colburn LLP

(57) ABSTRACT

A spark plug and an alloy for an electrode tip of a spark plug is disclosed herein. The spark plug having: an insulator shell; a center electrode inside the insulator shell such that one end of the center electrode protrudes from the insulator shell; a metal shell exterior to the insulator shell; a side ground electrode having one end coupled to the metal shell and the other end facing the protruding end of the center electrode to form a spark discharge gap between the center electrode and the side ground electrode; and an electrode tip secured to at least one of the side ground electrode or the center electrode, located at the spark discharge gap, the electrode tip comprising a platinum-based alloy comprising 20 to 35% by weight of palladium, from greater than 0 to 15% by weight iridium, and the balance of the alloy being platinum, all % by weight being based on the total weight of the alloy.

10 Claims, 1 Drawing Sheet

PLATINUM ALLOY FOR SPARK PLUG ELECTRODES AND SPARK PLUG HAVING A PLATINUM ALLOY ELECTRODE

CROSS REFERENCE TO RELATED APPLICATIONS

This patent application is a continuation application of U.S. Ser. No. 11/781,134, filed Jul. 20, 2007, which claims the benefit of U.S. Provisional Ser. No. 60/832,839 filed Jul. 24, 2006, the contents each of which are incorporated herein by reference thereto.

TECHNICAL FIELD

This application relates to an alloy for a spark plug electrode and a spark plug having a platinum alloy electrode.

BACKGROUND

The primary wear out mechanism for spark plugs in combustion engines is the failure of the electrodes due to service in oxidizing conditions at elevated temperatures with high sparking voltages. Precious metal alloys that are typically of a high percentage of platinum content are used to resist erosion caused by the previously mentioned mechanisms. For the side electrode application where the thermal stresses are more severe, the platinum alloy should include metals that help reduce thermal stress on the weld junction between the precious metal and the nickel alloy base electrode. Current platinum alloys have 10% nickel to better match the coefficient of thermal expansion (CTE) of the nickel base electrode that the platinum enhancement is welded onto. Over the last few years platinum prices have increased as much as 100%.

Accordingly, it is desirable to provide a lower cost yet durable platinum alloy for spark plug electrodes.

SUMMARY

Disclosed herein is a spark plug and an alloy for an electrode tip of a spark plug. The spark plug having: an insulator shell; a center electrode inside the insulator shell such that one end of the center electrode protrudes from the insulator shell; a metal shell exterior to the insulator shell; a side ground electrode having one end coupled to the metal shell and the other end facing the protruding end of the center electrode to form a spark discharge gap between the center electrode and the side ground electrode; and an electrode tip secured to at least one of the side ground electrode or the center electrode, located at the spark discharge gap, the electrode tip comprising a platinum-based alloy comprising 20 to 35% by weight of palladium, from greater than 0 to 15% by weight iridium, and the balance of the alloy being platinum, all % by weight being based on the total weight of the alloy.

In one non-limiting exemplary embodiment, the alloy comprises 20 to 35% by weight of palladium, from greater than 0 to 15% by weight iridium, and the balance of the alloy being platinum, all % by weight being based on the total weight of the alloy.

The above-described and other features and advantages of the present application will be appreciated and understood by those skilled in the art from the following detailed description, drawings, and appended claims.

DESCRIPTION OF EXEMPLARY EMBODIMENTS

Figure 1:
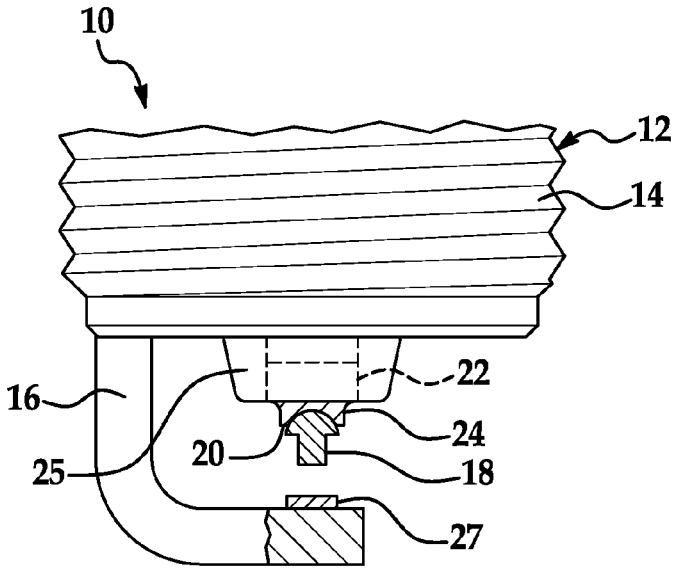
FIG. 1 is a cross-sectional view of a spark plug having a platinum based electrode tip constructed in accordance with an exemplary embodiment of the present invention.

In accordance with exemplary embodiments of the present invention the amount of platinum in the platinum alloy is reduced and replaced with palladium and optionally one or more additional metals such as iridium, nickel, ruthenium, tungsten, or combinations thereof In one exemplary embodiment, the additional metal will be iridium. Thus reducing the amount of platinum in the alloy while still having a coefficient of thermal expansion (CTE) close to that of the substrate (e.g., nickel of the center electrode or side electrode(s)) the electrode tip is secured to. In another embodiment, it is advantageous to reduce the amount of platinum in the alloy while maintaining a coefficient of thermal expansion equivalent to or approaching that of prior art platinum based alloys used to manufacture electrode tips. In some cases, such prior art platinum based alloys having 80 or more % by weight platinum, based upon the total weight of the alloy and in some cases 90 or more % by weight platinum, based upon the total weight of the alloy and preferably greater than 90% by weight platinum, based upon the total weight of the alloy.

Previous attempts to make diluted platinum alloys using the lower cost platinum groups metals; iridium and ruthenium, showed that the nickel could not be easily alloyed for the purpose of the CTE match Furthermore, previous attempts to make diluted platinum alloys using primarily lower cost platinum groups metals such as iridium and ruthenium resulted in alloys that did not have a desirable CTE, particularly in regard to the underlying nickel center or side electrodes.

In accordance with an exemplary embodiment of the present invention, palladium (another platinum group metal) is used as the main dilutent because it has a CTE very close to nickel. This approach minimizes thermal expansion rate stresses between the platinum alloy enhancement and the base nickel alloy it is secured to. Also, palladium and iridium are lower cost precious metals that have good oxidation resistance and high melting temperatures, which are particularly useful in spark plug applications.

In accordance with exemplary embodiments of the present invention, a sphere, cut wire/cylinder or rivet formed from any one of the platinum alloys of exemplary embodiments of the present invention is formed as an electrode tip and is resistance welded to a Ni-based alloy electrode. As used herein a Ni-based electrode includes a Ni-based electrode such that it is desirable to have an electrode tip with a CTE close to that of the nickel alloy of the electrode. Alternatively, it is desirable to have an electrode tip with a CTE close to that of prior art platinum alloys traditionally used for electrode tips, especially all or substantially all platinum electrode tips. Of course, other equivalent methods for securement of the platinum alloy electrode tip to the electrode are contemplated to be within the scope of exemplary embodiments of the present invention.

In one exemplary embodiment, the platinum alloy is 25-35 weight percent palladium, greater than 0 to 10 weight percent iridium and the balance being platinum, based on the total weight of the disclosed lower cost platinum alloy. In still another alternative exemplary embodiment the platinum alloy is 15-35 weight percent palladium, greater than 0 to 10 weight percent iridium and the balance being platinum. In still another alternative exemplary embodiment the disclosed low cost platinum alloy is 15-39 weight percent palladium, greater than 0 to 10 weight percent iridium and the balance being platinum. In still yet another alternative exemplary embodiment the platinum alloy is greater than 0-39 weight percent palladium, greater than 0 to 10 weight percent iridium and the balance being platinum.

In one embodiment, the disclosed low cost platinum alloys for electrode tips will comprise at least 10% by weight of palladium and at least 50% by weight of platinum, based on the total weight of the alloy. In one embodiment, the balance of the alloy will be platinum. In another embodiment, the disclosed low cost platinum alloys for electrode tips will comprise at least 15% by weight of palladium and at least 50% by weight of platinum, based on the total weight of the alloy. In yet another embodiment, the disclosed low cost platinum alloys for electrode tips will comprise at least 20% by weight of palladium and at least 50% by weight of platinum, based on the total weight of the alloy.

In one embodiment, the disclosed low cost platinum alloys for electrode tips will comprise no more than 45% by weight of palladium and at least 50% by weight of platinum, based on the total weight of the alloy. In another embodiment, the disclosed low cost platinum alloys for electrode tips will comprise no more than 40% by weight of palladium and at least 50% by weight of platinum, based on the total weight of the alloy. In another embodiment, the disclosed low cost platinum alloys for electrode tips will comprise no more than 35% by weight of palladium and at least 50% by weight of platinum, based on the total weight of the alloy.

In another exemplary embodiment, the disclosed low cost platinum alloys for electrode tips will comprise from greater than 0 to 39% palladium and at least 50% by weight of platinum, based on the total weight of the alloy. In another embodiment, the disclosed low cost platinum alloys for electrode tips will comprise from 15 to 39% palladium and at least 50% by weight of platinum, based on the total weight of the alloy. In yet another embodiment, the disclosed low cost platinum alloys for electrode tips will comprise from 15 to 35% palladium and at least 50% by weight of platinum, based on the total weight of the alloy. In another embodiment of the disclosed low cost platinum alloys for electrode tips, the disclosed alloy may also comprise in addition to the foregoing ranges of palladium and platinum, one or more additional metals.

In one exemplary embodiment, these one or more additional metals may be selected from the group consisting of nickel, iridium, ruthenium, or tungsten. In one embodiment, the disclosed alloy may also comprise in addition to the foregoing ranges of palladium and platinum combinations of one or more of these one or more additional metals. In another exemplary embodiment, the additional metal will be either nickel or iridium. In one especially exemplary embodiment, the additional metal will be iridium.

For example, in one embodiment, the disclosed low cost platinum alloys for electrode tips may further comprise from 0 to 40% of such an additional metal, based on the total weight of the alloy. In another embodiment, the disclosed low cost platinum alloys for electrode tips may also comprise from 1 to 30% of the additional metal, based on the total weight of the alloy. In yet another embodiment, the disclosed low cost platinum alloys for electrode tips will comprise from 5 to 15% of the additional metal based on the total weight of the alloy.

Thus, it will be appreciated that in another exemplary embodiment, the disclosed low cost platinum alloys for electrode tips will comprise from greater than 0 to 39% palladium, at least 50% by weight of platinum, and from 0 to 40% by weight of an additional metal, based on the total weight of the alloy, with the balance of the alloy being platinum. In another embodiment, the disclosed low cost platinum alloys for electrode tips will comprise from 15 to 39% palladium, from 1 to 30% of an additional metal and at least 50% by weight of platinum, based on the total weight of the alloy, with the balance of the alloy being platinum. In yet another embodiment, the disclosed low cost platinum alloys for electrode tips will comprise from 15 to 35% palladium, from 5 to 15% of an additional metal, and at least 50% by weight of platinum, based on the total weight of the alloy, with the balance of the alloy being platinum. In one especially desirable embodiment, the disclosed low cost platinum alloys for electrode tips will comprise from 25 to 35% palladium, from 5 to 10% of an additional metal, and at least 50% by weight of platinum, based on the total weight of the alloy, with the balance of the alloy being platinum.

Other exemplary embodiments of platinum alloys for electrode tips are shown in the examples below.

Platinum Alloy Example 1

| Elements | Weight % |
|---|---|
| Pt | 55 |
| Pd | 40 |
| Ni | 5 |

Platinum Alloy Example 2

| Elements | Weight % |
|---|---|
| Pt | 55 |
| Ir | 10 |
| Pd | 35 |

Platinum Alloy Example 3

| Elements | Weight % |
|---|---|
| Pt | 65 |
| Ir | 10 |
| Pd | 25 |

Platinum Alloy Example 4

| Elements | Weight % |
|---|---|
| Pt | 65 |
| Pd | 30 |
| Ni | 5 |

| Platinum Alloy Example 5 | |
|---|---|
| Elements | Weight % |
| Pt | 55 |
| Ru | 10 |
| Pd | 35 |

| Platinum Alloy Example 6 | |
|---|---|
| Elements | Weight % |
| Pt | 65 |
| Ru | 10 |
| Pd | 25 |

| Platinum Alloy Example 7 | |
|---|---|
| Elements | Weight % |
| Pt | 65 |
| Ru | 30 |
| Ni | 05 |

| Platinum Alloy Example 8 | |
|---|---|
| Elements | Weight % |
| Pt | 55 |
| Ir | 20 |
| Pd | 25 |

| Platinum Alloy Example 9 | |
|---|---|
| Elements | Weight % |
| Pt | 65 |
| Ir | 20 |
| Pd | 25 |

| Platinum Alloy Example 10 | |
|---|---|
| Elements | Weight % |
| Pt | 65 |
| Ir | 25 |
| Ni | 10 |

| Platinum Alloy Example 11 | |
|---|---|
| Elements | Weight % |
| Pt | 75 |
| Ru | 20 |
| W | 5 |

| Platinum Alloy Example 12 | |
|---|---|
| Elements | Weight % |
| Pt | 84 |
| Ru | 6 |
| Pd | 10 |

As discussed herein the electrode tip may be a rivet, sphere, cut wire/cylinder formed and attached in accordance with the teachings of U.S. Pat. Nos. 5,456,624 and 4,840,594 the contents of which are incorporated herein by reference thereto. Non-limiting methods for attaching the electrode tip include, laser welding, electron beam welding, resistance welding, brazing, deformation resistance welding, mechanical securement, combinations of any of the foregoing and any equivalents thereof, wherein a portion of the electrode tip is fused, welded and secured to the electrode.

Referring now to FIG. 1, a spark plug generally indicated by the numeral 10 includes an annular metal housing 12 which is threaded at 14 for installation into an internal combustion engine (not shown). A ground electrode or side ground electrode 16 extends from the housing 12 to define a firing gap with a center electrode 22. Alternatively, a pair or multiple side ground electrodes may be present. The center electrode in one embodiment includes an electrode tip comprising a rivet 18 or sphere (not shown) of metal, which in one exemplary embodiment is formed from any one of the platinum alloys disclosed herein and is secured to the end face 20 of an outer sheath 24 which projects from an insulator 25, which is mounted within the housing 12. In addition, the ground electrode 16 also includes an electrode tip 27 configured as a pad and is secured to the ground electrode, which in one exemplary embodiment is formed from any one of the platinum alloys disclosed herein. It will be appreciated that in one embodiment, the electrode tip 27 may comprise the lower cost platinum alloys disclosed herein. In another embodiment, the electrode tip 27 will consist of the lower cost platinum alloys disclosed herein. In accordance with exemplary embodiments of the present invention the electrode tips of both the center electrode and/or side electrodes may be pads, spheres, rivets, wires, cylinders or any other suitable shape.

In accordance with an exemplary embodiment electrode tip formed from the rivet, cut wire/cylinder, pad or sphere is formed from any one of the platinum alloys disclosed herein.

Figure 2:
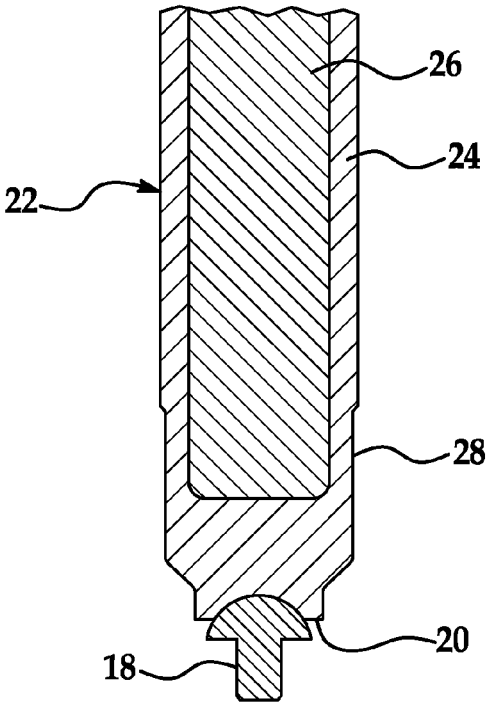
FIG. 2 is a cross-sectional view of a center electrode formed in accordance with one exemplary embodiment of the present invention.

Referring now to FIG. 2 a non-limiting exemplary embodiment of the present invention is illustrated, here the center electrode 22 includes the outer sheath 24 which receives a copper core 26. The outer sheath 24 terminates in an end section having a necked-down portion 28, which terminates in the end face 20. In accordance with an exemplary embodiment the outer sheath 22, the neck down portion 28 and the end face 20 comprise a nickel based alloy and thus it is desirable to have an electrode with a CTE close to that of the portion of the electrode the electrode tip is secured to.

Figure 3:
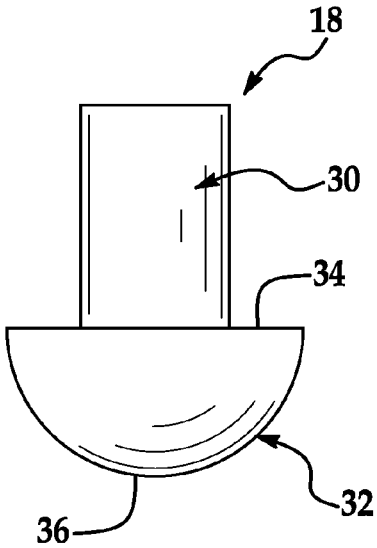
FIG. 3 is a side view of an electrode tip formed in accordance with one exemplary embodiment of the present invention.

Referring now to FIG. 3 and in a non-limiting exemplary embodiment, the electrode tip comprises a rivet 18 that includes a shank portion 30 and a head 32. The shank portion 30 extends from a substantially flat side 34 of the head 32. The other side of the head 32 is a continuously curving, spherical surface 36. Accordingly, the head 32 is substantially hemispherical, and the spherical surface 36 intersects the surface 34 at a circle, the radius of which is substantial equal to the radius of the spherical surface 36. As discussed above, the rivet 18 is made from a metal, such as anyone of the platinum alloys disclosed herein. Alternatively, the electrode tips are formed from a plurality of pads wherein one is secured to the ground electrode or each or the ground electrodes and another pad is secured to the center electrode.

Formation of the center electrode 22 may be formed as described in U.S. Pat. No. 4,705,486, the contents of which are incorporated herein by reference thereto.

Reference is also made to the following U.S. Pat. Nos. 4,725,254; 4,810,220; 4,840,594; 5,091,672; 5,697,334; 5,918,571; 5,980,345; 5,456,624; 5,973,443; 6,045,424; 6,071,163; and 6,104,130, the contents each of which is also incorporated herein by reference thereto.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims and their legal equivalence.

What is claimed is:

1. A spark plug comprising:

an insulator shell;

a center electrode inside the insulator shell such that one end of the center electrode protrudes from the insulator shell;

a metal shell exterior to the insulator shell;

a side ground electrode having one end coupled to the metal shell and the other end facing the protruding end of the center electrode to form a spark discharge gap between the center electrode and the side ground electrode; and an electrode tip secured to at least one of the side ground electrode or the center electrode, located at the spark discharge gap, the electrode tip comprising a platinum-based alloy comprising 20 to 35% by weight of palladium, from greater than 0 to 15% by weight iridium, and the balance of the alloy being platinum, all % by weight being based on the total weight of the alloy.

2. A spark plug according to claim 1, wherein the electrode tip is secured to both the center electrode and the side ground electrode and the electrode tips have a coefficient of thermal expansion (CTE) that is similar to that of the center electrode and the side ground electrode.

3. A spark plug according to claim 1, wherein the center electrode and the side ground electrode comprise nickel based alloys.

4. A spark plug according to claim 2, wherein the electrode tips are configured as a pad or rivet or a wire.

5. A spark plug according to claim 1 wherein the electrode tip is joined to the center electrode or the side ground electrode by resistance welding.

6. A spark plug according to claim 1, wherein the platinum based metal comprises 5 to 10% by weight of iridium.

7. The spark plug according to claim 1, wherein the platinum alloy comprises 35 weight percent palladium, 10 weight percent iridium and 55 weight percent platinum.

8. The spark plug according to claim 1, wherein the platinum alloy comprises 25 weight percent palladium, 10 weight percent iridium and 65 weight percent platinum.

9. The spark plug according to claim 1, wherein the platinum alloy comprises 23 weight percent palladium, 10 weight percent iridium and 67 weight percent platinum.

10. An electrode tip for a spark plug, the electrode tip being formed from a platinum alloy comprising 20 to 35% by weight of palladium, from greater than 0 to 15% by weight iridium, and the balance of the alloy being platinum, all % by weight being based on the total weight of the alloy.

* * * * *